US009835985B2

(12) United States Patent
Kishi

(10) Patent No.: US 9,835,985 B2
(45) Date of Patent: Dec. 5, 2017

(54) IMAGE FORMING APPARATUS

(71) Applicant: CANON KABUSHIKI KAISHA, Tokyo (JP)

(72) Inventor: Takehiro Kishi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/196,372

(22) Filed: Jun. 29, 2016

(65) Prior Publication Data

US 2017/0003626 A1 Jan. 5, 2017

(30) Foreign Application Priority Data

Jul. 2, 2015 (JP) ..... 2015-133804

(51) Int. Cl.
*G03G 15/16* (2006.01)

(52) U.S. Cl.
CPC ..... *G03G 15/161* (2013.01); *G03G 15/1605* (2013.01); *G03G 15/168* (2013.01); *G03G 2215/0129* (2013.01); *G03G 2215/1623* (2013.01)

(58) Field of Classification Search
CPC ..... G03G 15/161
See application file for complete search history.

(56) References Cited

U.S. PATENT DOCUMENTS 7,251,433 B2 7/2007 Ai et al.
2007/0059027 A1* 3/2007 Ishikawa ..... G03G 15/161 399/101
2007/0286621 A1* 12/2007 Nishikawa ..... G03G 15/0131 399/49
2011/0158677 A1* 6/2011 Kikuchi ..... G03G 15/161 399/101
2011/0229187 A1* 9/2011 Hozumi ..... G03G 15/161 399/101
2011/0229234 A1* 9/2011 Hozumi ..... G03G 15/161 399/357
2012/0224870 A1* 9/2012 Kikuchi ..... G03G 15/161 399/44
2013/0315617 A1* 11/2013 Sugiura ..... G03G 15/161 399/101
2014/0023393 A1* 1/2014 Takai ..... G03G 21/0035 399/101

(Continued)

FOREIGN PATENT DOCUMENTS

JP 2005-338785 A 12/2005
JP 2007-121568 A 5/2007

(Continued)

*Primary Examiner* — Sevan A Aydin
(74) *Attorney, Agent, or Firm* — Fitzpatrick, Cella, Harper & Scinto

(57) ABSTRACT

An image forming apparatus includes a member-to-be-cleaned, a first cleaner unit including a first attracting member, a first rotatable member and a first blade member, a second cleaner unit including a second attracting member, a second rotatable member and a second blade member, and a feeding member. The feeding member rotates around its rotational axis and is provided vertically below a first position where a toner drops by gravitation and a second position where the toner drops by gravitation. The feeding member is disposed such that vertical lines passing through the first position and the second position cross the feeding member.

11 Claims, 8 Drawing Sheets

(56) References Cited

U.S. PATENT DOCUMENTS

| | | | | |
|---|---|---|---|---|
| 2014/0064769 | A1* | 3/2014 | Sugiura | G03G 21/0035 399/71 |
| 2014/0147181 | A1* | 5/2014 | Sugiura | G03G 15/161 399/349 |
| 2015/0338784 | A1* | 11/2015 | Ai | G03G 15/161 399/85 |
| 2016/0041508 | A1* | 2/2016 | Kogure | G03G 15/161 399/316 |
| 2016/0054700 | A1* | 2/2016 | Takai | G03G 21/0076 399/353 |
| 2016/0091832 | A1* | 3/2016 | Omata | G03G 15/161 399/101 |
| 2017/0003624 | A1* | 1/2017 | Omata | G03G 15/161 |

FOREIGN PATENT DOCUMENTS

| | | | | |
|---|---|---|---|---|
| JP | 2007121568 | A | * | 5/2007 |
| JP | 2012128250 | A | * | 7/2012 |
| JP | 2013-003543 | A | | 1/2013 |
| JP | 2013003543 | A | * | 1/2013 |
| JP | 2013-057703 | A | | 3/2013 |

* cited by examiner

IMAGE FORMING APPARATUS

FIELD OF THE INVENTION AND RELATED ART

The present invention relates to an image forming apparatus including a cleaning device for cleaning a surface of a member-to-be-cleaned.

Conventionally, as disclosed in Japanese Laid-Open Patent Application (JP-A) 2013-57703, a cleaning device for cleaning an intermediary transfer belt, in which a first unit for removing a toner by using a positive bias voltage and a second unit for removing the toner by using a negative bias voltage are provided has been provided. In this cleaning device, each of the first unit and the second unit includes a brush roller for attracting the toner deposited on an intermediary transfer belt and a collecting roller for collecting the toner attracted to the brush roller. Further, each of the first unit and the second unit includes a scraping blade for scraping the deposited toner off the collecting roller and a screw for feeding the toner scraped off the collecting roller by the scraping blade to an outside of the cleaning device.

The cleaning device disclosed in JP-A 2013-57702 had a constitution in which each of the first unit and the second unit was provided with the screw. For this reason, there is a need to ensure a space for placement of these (plurality of) screws and there is a need to provide a motor, a gear and the like for driving these screws, so that reduction of part (component) costs and downsizing of the cleaning device are hindered. Therefore, it would be considered that a deposited matter such as the toner is scraped off by the plurality of scraping members. In this case, when one of the scraping members is disposed below the other scraping member, the toner scraped by the other scraping member drops on the one of the scraping members, and therefore it would be considered that their positions are shifted in a horizontal direction. In the case where the toner scraped off by the plurality of scraping members disposed as described above is intended to be fed by a single feeding member, for example, it would be considered that a wall surface of a container covering the cleaning device is inclined and is used for feeding the toner. That is, a deposited matter scraped by the plurality of scraping members is collected on the feeding member by using the inclined wall surface.

However, in the case where such a constitution is employed, there is a possibility that the deposited matter scraped by the two (first and second) scraping members is deposited on the wall surface of the container. Then, when the deposited matter is further deposited on the deposited matter which has already been deposited, the deposited matter clogs inside the cleaning device, so that the deposited matter scraped off the roller cannot collected on the feeding member. In this case, there is a liability that the cleaning device is contaminated with the deposited matter which overflowed from the cleaning device.

SUMMARY OF THE INVENTION

According to an aspect of the present invention, there is provided an image forming apparatus for forming an image with a toner, comprising: a movable member-to-be-cleaned on which the toner is deposited; a first cleaning unit configured to remove the toner deposited on the member-to-be-cleaned, the first cleaning unit including a first attracting member, a first rotatable member and a first blade member, wherein the first attracting member contacts the member-to-be-cleaned while rotating and is supplied with a voltage of a first polarity to attract the toner deposited on the member-to-be-cleaned, wherein the first rotatable member contacts the first attracting member to move the toner from the first attracting member thereto, wherein the first blade member contacts the first rotatable member at a first contact portion and scrapes a deposited matter off the first rotatable member with rotation of the first rotatable member, and the toner scraped off by the first blade member drops by gravitation at a first position in a neighborhood of the first contact portion, a second cleaning unit configured to remove the toner deposited on the member-to-be-cleaned, the second cleaning unit including a second attracting member, a second rotatable member and a second blade member, wherein the second attracting member contacts the member-to-be-cleaned while rotating and is supplied with a voltage of a second polarity to attract the toner deposited on the member-to-be-cleaned, wherein the second rotatable member contacts the second attracting member to move the toner from the second attracting member thereto, wherein the second blade member contacts the second rotatable member at a second contact portion and scrapes a deposited matter off the second rotatable member with rotation of the second rotatable member, and the toner scraped off by the second blade member drops by gravitation at a second position in a neighborhood of the second contact portion; and a feeding member configured to feed the toner dropped from the first position and the second position in a direction of a rotational axis thereof, wherein the feeding member rotates around the rotational axis and is provided vertically below the first position and the second position, and wherein the feeding member is disposed such that vertical lines passing through the first position and the second position cross the feeding member.

Further features of the present invention will become apparent from the following description of exemplary embodiments with reference to the attached drawings.

DESCRIPTION OF THE EMBODIMENTS

With reference to the drawings, image forming apparatuses according to First and Second Embodiments of the present invention will be described. In the following description, on the basis of a point of sight of the image forming apparatus from a front side (FIG. 1), an up-down direction and a left-right direction are shown.

First Embodiment

[Image Forming Apparatus]

Figure 1:
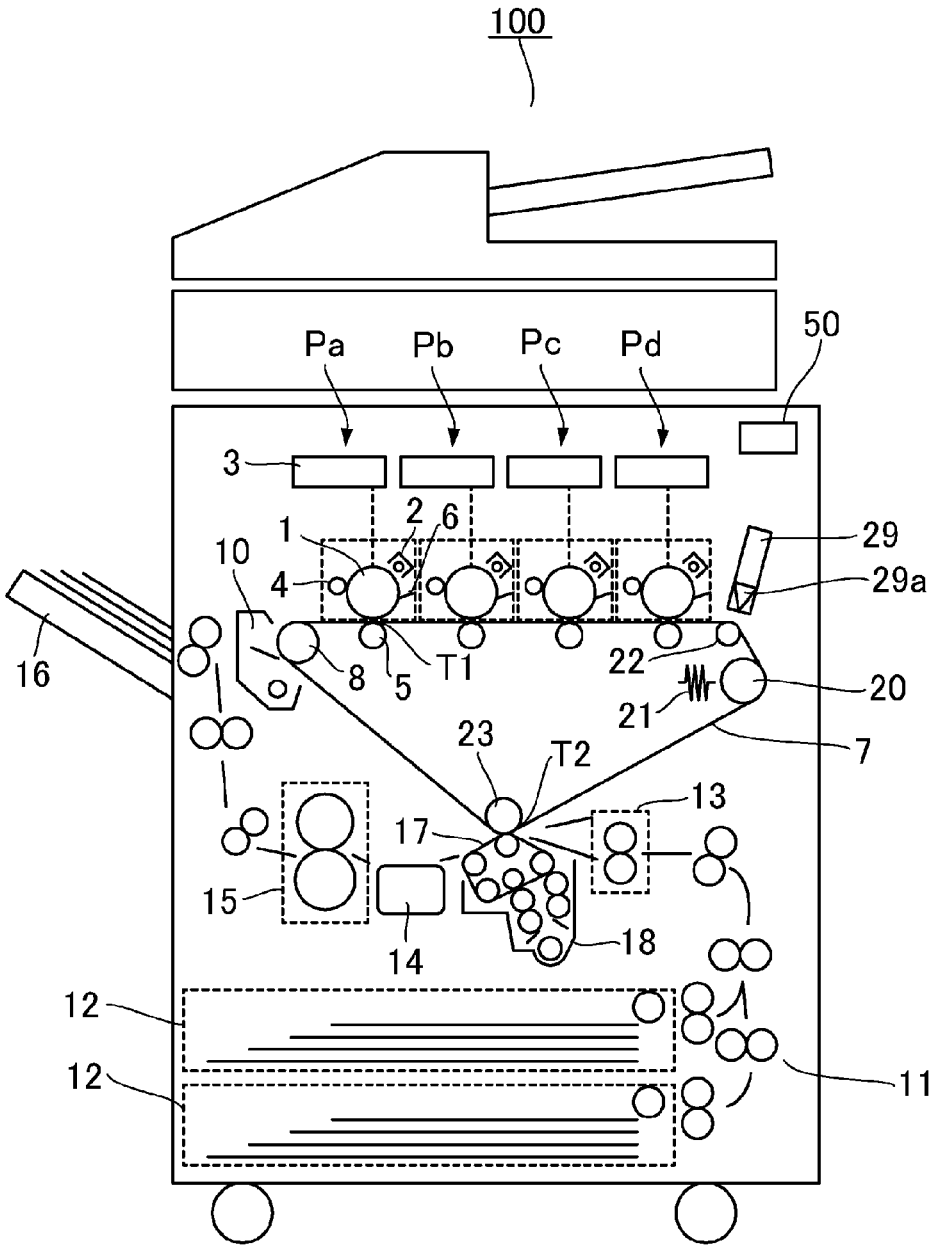
FIG. 1 is a schematic structural view showing an image forming apparatus according to First Embodiment of the present invention.

An image forming apparatus 100 according to First Embodiment is, as shown in FIG. 1, a color image forming apparatus of an electrophotographic type. The image forming apparatus 100 includes stations Pa, Pb, Pc and Pd as image forming portions for forming toner images of 4 colors of yellow (Pa), magenta (Pb), cyan (Pc) and black (Pd). The image forming apparatus 100 is a tandem image forming apparatus of an intermediary transfer type in which these stations Pa, Pb, Pc and Pd are disposed along an intermediary transfer belt 7.

In the following, a constitution of the stations will be described using the station Pa for yellow as an example. Other stations Pb, Pc and Pd have the same constitution as the constitution of the station Pa except for the colors of the toners, and therefore, will be omitted from description. The station Pa includes a photosensitive drum 1 rotating along a feeding direction of the intermediary transfer belt 7, and includes a charging portion 2, an exposure portion 3, a developing portion 4, a primary transfer portion T1, a cleaning portion 6 and the like which are provided along a rotational direction of the photosensitive drum 1.

The photosensitive drum 1 as an image bearing member is electrically charged uniformly at a surface thereof by the charging portion 2. The exposure portion 3 includes a light-emitting portion subjected to light emission control correspondingly to an image signal by a control device 50 provided in an apparatus main assembly and a mirror portion for guiding laser light from the light-emitting portion to the photosensitive drum 1 to scan the surface of the photosensitive drum 1 with the laser light. On the surface of the photosensitive drum 1, surface electric charges are removed by the laser light emitted from the exposure portion 3 and an electrostatic latent image is formed.

The developing portion includes a developing sleeve rotating while carrying the toner on a surface thereof, and the electrostatic latent image on the photosensitive drum 1 is visualized (developed) as a toner image by the toner supplied from the developing sleeve to the photosensitive drum 1. A primary transfer portion T1 is formed as a nip between the photosensitive drum 1 and a primary transfer roller 5 opposing the photosensitive drum 1 via the intermediary transfer belt 7. The primary transfer roller 5 is connected with an unshown high-voltage output substrate, and a primary transfer bias voltage is applied thereto. The toner image carried on the photosensitive drum 1 is urged and transferred by the primary transfer bias voltage from the photosensitive drum 1 onto the intermediary transfer belt 7. A residual toner or the like which passes through the primary transfer portion T1 and which remains on the photosensitive drum 1 is removed by the cleaning portion 6 including a cleaning blade, so that the surface of the photosensitive drum 1 is again in a state in which the toner image is capable of being carried thereon. Such a toner image forming process is also performed at other stations Pb, Pc and Pd in parallel, so that associated toner images are transferred onto the intermediary transfer belt 7 so as to be superposed on the yellow toner image, and thus a full-color toner image is formed.

The intermediary transfer belt 7 as an image bearing member for carrying and feeding the toner image is an endless belt disposed so as to extend through the primary transfer portions T1 of the 4 stations Pa, Pb, Pc and Pd which are disposed in a horizontal direction. The intermediary transfer belt 7 is supported at the primary transfer portions T1 and is extended around a driving roller 8, a tension roller 20, a stretching roller 22 and an inner secondary transfer roller 23.

The intermediary transfer belt 7 is rotationally driven in a predetermined feeding direction (clockwise direction) by the driving roller 8 driven by an unshown driving device. The tension roller 20 is provided slidably (movably) in a direction of urging the intermediary transfer belt 7 toward an outer peripheral surface side and is urged by an urging (pressing) spring 21 connected with each of both end portions thereof, so that a proper tension is applied to the intermediary transfer belt 7. The inner secondary transfer roller 23 sandwiches the intermediary transfer belt 7 and a secondary transfer belt 176 between itself and an outer secondary transfer roller 172 of a secondary transfer unit 17 described later, so that a secondary transfer portion T2 is formed between the intermediary transfer belt 7 and the secondary transfer belt 176. Downstream of the secondary transfer portion T2, an intermediary transfer belt cleaning portion 10 for collecting the toner or the like which passes through the secondary transfer portion T2 and which remains on the surface of the intermediary transfer belt 7 is provided.

Of the 4 stations pa, Pb, Pc and Pd, in a side downstream of the most downstream station Pd with respect to the feeding direction of the intermediary transfer belt 7, a sensor unit 29 for reading a control patch (registration patch) for correcting color misregistration is provided. The sensor unit 29 includes a detecting portion 29*a* for detecting the control patch formed on the surface of the intermediary transfer belt 7. Incidentally, a portion of the intermediary transfer belt 7 opposing the detecting portion 29*a* is supported by the stretching roller 22.

Figure 2:
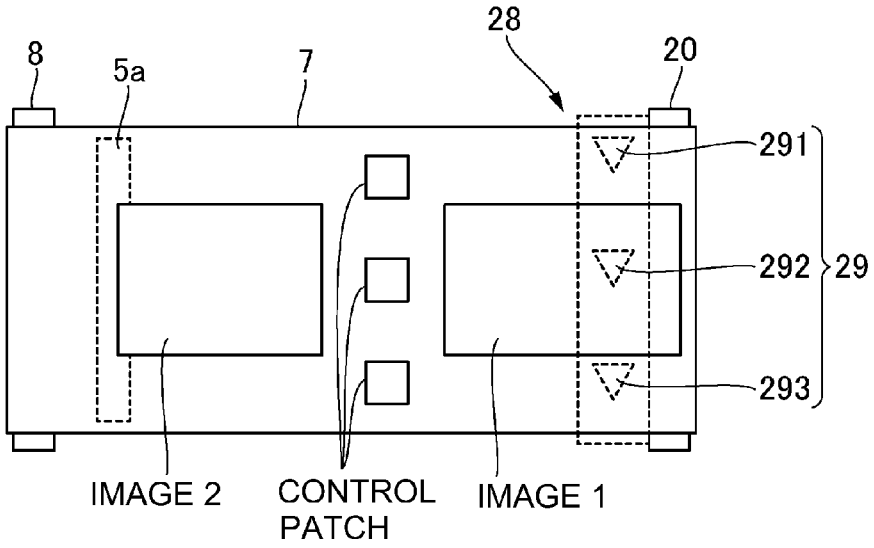
FIG. 2 is a schematic view showing a position of a control patch formed on an intermediary transfer belt in First Embodiment.

The sensor unit 29 is, as shown in FIG. 2, constituted by arranging side portion sensors 291 and 293 provided on both sides with respect to a widthwise direction of the intermediary transfer belt 7 and a central portion sensor 292 provided at a widthwise central portion, in the widthwise direction of the intermediary transfer belt 7. The sensor unit 29 reads control patches formed at 3 positions corresponding to the side portion sensors 291 and 293 and the central portion sensor 292, and detects occurrence or non-occurrence of deviation of transfer positions by the 4 stations Pa, Pb, Pc and Pd. These control patches are formed in a region between the toner images to be transferred onto a recording material P at the secondary transfer portion T2. In other words, the control patches are formed between a region (first region) where a toner image ("IMAGE 1") to be transferred onto a first recording material P1 (FIG. 3) is formed and a region (second region) where a toner image ("IMAGE 2") to be transferred onto a second recording material P2 is formed. However, the first recording material P1 refers to a preceding one of the recording materials P and P which successively pass through the secondary transfer portion T2, and the second recording material P2 refers to the recording material passing through the secondary transfer portion T2 subsequently to the first recording material P1.

The control device 50 as a control means provided in the apparatus main assembly not only causes the stations Pa, Pb, Pc and Pd to form the control patches but also monitors an inside state (occurrence or non-occurrence of positional deviation of transfer positions) by a feed-back signal sent from the sensor unit 29. In the case where the positional deviation of the toner images is detected, the control device 50 sends an instruction to correct the positional deviation to the associated station. As a result, the inside state is automatically monitored and appropriately corrected without causing a user to perform a positional deviation correcting operation, and therefore, the image forming apparatus 100 is maintained in a state in which productivity is high.

Incidentally, a constitution in which a density sensor capable of detecting a density of density patches is provided as the sensor unit 29 and density correction is made by forming the density patches prepared at predetermined gradation levels separately from the control patches prepared for the purpose of correcting the color misregistration may also be added. Further, a detection position by the detecting portion 29*a* is not limited to the above-described position and the number, but the patches may also be disposed at, e.g., two positions which are symmetrical with respect to the widthwise direction.

The image forming apparatus 100 includes, in addition to the above-described 4 stations and intermediary transfer belt 7, accommodating portions 12, a feeding portion 11, a registration adjusting portion 13, the secondary transfer unit 17, the cleaner unit 18, a fixing portion 15, a discharge tray 16 and the like as shown in FIG. 1.

The recording material P (such as paper or an OHP sheet) staked in each of the accommodating portions 12 is fed by the feeding portion 11 through the inside of the apparatus main assembly and is subjected to correction of oblique movement by the registration adjusting portion 13.

At the secondary transfer portion T2, the toner images are transferred from the intermediary transfer belt 7 onto the recording material P fed from the registration adjusting portion 13. The recording material P passed through the secondary transfer portion T2 is attracted to a pre-fixing feeding belt 14 provided with a suction fan, and then is fed to the fixing portion 15. The recording material P is heated and pressed by being sandwiched between a fixing roller pair of the fixing portion 15, so that an image fixed on the recording material P can be obtained. The recording material P passed through the fixing portion 15 is fed to a discharging feeding portion and is discharged to a discharge tray 16 exposed to an outside of the apparatus main assembly. In the case of double-sided printing or the like, when an image is formed on a back surface, the recording material P passed through the fixing portion 15 is fed again toward the secondary transfer portion T2 in a state in which the recording material P is turned upside down by an unshown reverse feeding portion. Then, the image is formed on the back surface of the recording material P, and thereafter, the recording material P passes through the fixing portion 15 and the discharging feeding portion, and then is discharged on the discharge tray 16.

[Secondary Transfer Unit]

The secondary transfer unit 17 for forming the secondary transfer portion T2 between itself and the intermediary transfer belt 7 will be described. The secondary transfer unit 17 is, as shown in FIG. 1, disposed between the registration adjusting portion 13 and the pre-fixing feeding belt 14 in a left-right direction. The secondary transfer unit 17 is accommodated, together with the cleaner unit 18 described later, inside a casing 192 detachably mounted in the apparatus main assembly of the image forming apparatus 100. The casing 192 extends along the widthwise direction (front-rear direction of the apparatus main assembly) of the intermediary transfer belt 7 and is formed to open upwardly.

Figure 3:
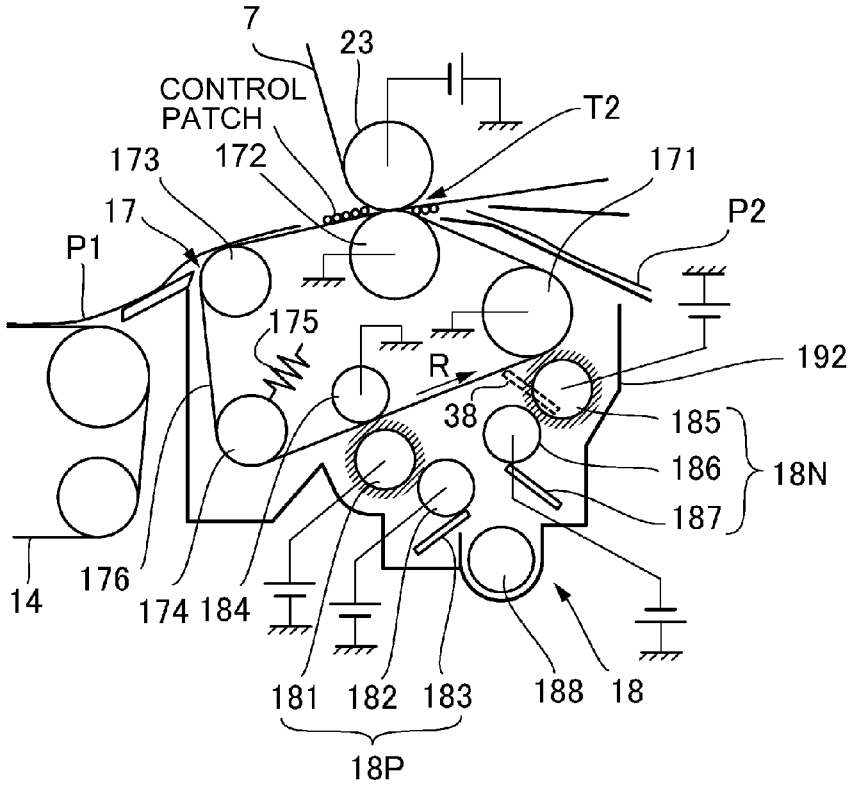
FIG. 3 is a sectional view showing a secondary transfer unit and a cleaner unit in First Embodiment.

The secondary transfer unit 17 is, as shown in FIG. 3, constituted by winding the secondary transfer belt 176 which is an endless belt member around a driving roller 171, the outer secondary transfer roller 172, a separation roller 173 and a tension roller 174. The driving roller 171, the outer secondary transfer roller 172, the separation roller 173 and the tension roller 174 are not only disposed in parallel to the inner secondary transfer roller 23 but also rotatably supported by the casing 192 at both end portions with respect to an axial direction.

The secondary transfer belt T2 is formed as the nip between the intermediary transfer belt 7 and the secondary transfer belt 176 which are sandwiched between the inner secondary transfer roller 23 and the outer secondary transfer roller 172. At the secondary transfer portion T2, the recording material P is fed leftwardly in a state in which the recording material P is sandwiched between the intermediary transfer belt 7 and the secondary transfer belt 176. Accordingly, the secondary transfer belt 176 is a transfer feeding belt for feeding the recording material P while sandwiching the recording material P between itself and the intermediary transfer belt 7.

The outer secondary transfer roller 172 is grounded, and on the other hand, the inner secondary transfer roller 23 is connected with the high-voltage output substrate and is supplied with a negative bias voltage. In this embodiment, toner particles of the toner images and the control patches which are carried on the intermediary transfer belt 7 are charged to the negative polarity, and therefore in accordance with an electrostatic bias at the secondary transfer portion T2, the toner particles are moved from the intermediary transfer belt 7 toward the secondary transfer belt 176. As a result, not only the toner images are secondary-transferred onto the recording material P passing through the secondary transfer portion T2, but also the control patches are transferred onto the secondary transfer belt 176 between the recording materials P successively passing through the secondary transfer portion T2. The toner of the control patches transferred on the secondary transfer belt 176 is collected by the cleaner unit 18 as described later.

The driving roller 171 is rotationally driven by an unshown driving motor, and feeds the secondary transfer belt 176. The secondary transfer belt 176 is fed leftwardly in an upper side and is fed rightwardly in a lower side where the cleaner unit 18 is disposed. A feeding speed of the secondary transfer belt 176 is controlled so as to be substantially the same as the feeding speed of the intermediary transfer belt 7 at the secondary transfer portion T2. The tension roller 174 is urged by a tension spring 175 which is an elastic member and urges (presses) the intermediary transfer belt 7, so that the secondary transfer belt 176 is maintained in a state in which the secondary transfer belt 176 has a proper tension. The separation roller 173 disposed downstream of the outer secondary transfer roller 172 with respect to the feeding direction of the secondary transfer belt 176 is constituted so as to be capable of separating the recording material P from the secondary transfer belt 176 by curvature (separation), and delivers the recording material P to the pre-fixing feeding belt 14.

[Cleaner Unit]

Next, the cleaner unit 18 as a cleaning device for cleaning the secondary transfer belt 176 as a member-to-be-cleaned will be described. The cleaner unit 18 is, as shown in FIG. 3, the cleaning device of an electrostatic brush type in which a positive polarity cleaning set 18P and a negative polarity cleaning set 18N which are used for cleaning the surface of the secondary transfer belt 176 by using an electrostatic bias, and a feeding screw 188 are provided. The image forming apparatus 100 is provided with an unshown toner collecting container, and the deposited matter removed from the surface of the secondary transfer belt 176 is finally accommodated in the toner collecting container.

Figure 5:
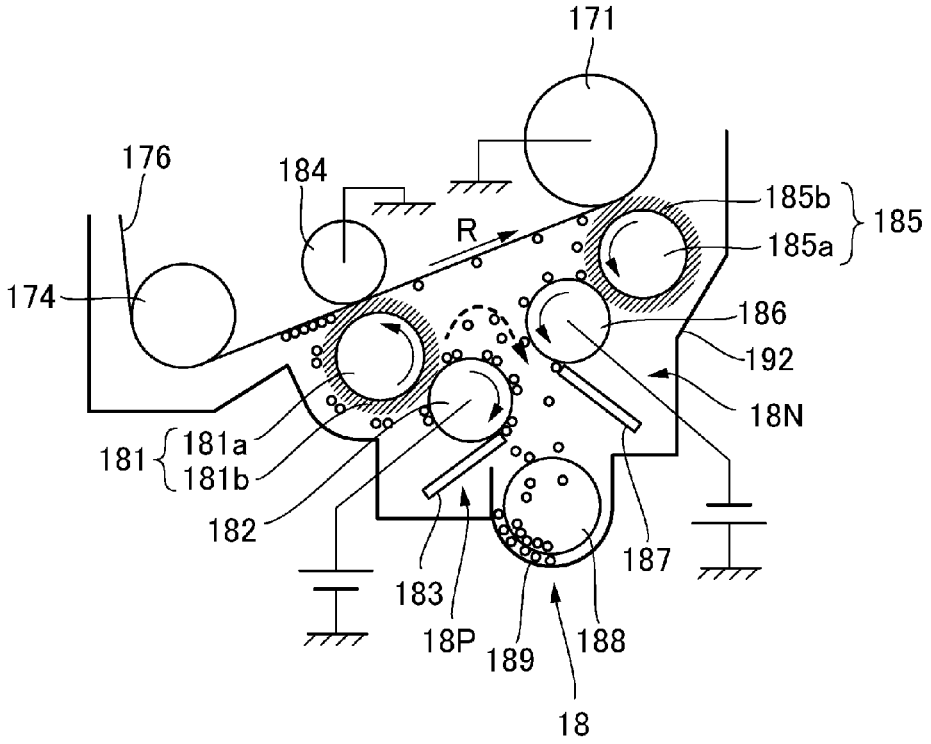
FIG. 5 is a sectional view for illustrating an operation of the cleaner unit in First Embodiment.

The positive polarity cleaning set 18P includes a brush roller 181 as a first attracting member, a bias roller 182 as a first collecting member and a cleaning blade 183 as a first scraping member. The brush roller 181 which is a brush member (fur brush roller) is constituted by, e.g., planting electroconductive brush fibers 181*b* in a cylindrical core portion 181*a* formed of a metal material (FIG. 5). This brush roller 181 contacts a lower surface of the secondary transfer belt 176 and sandwiches the secondary transfer belt 176 between itself and an opposing roller 184 provided in an inner peripheral surface side of the secondary transfer belt 176. The bias roller 182 which is a roller member is disposed in a lower-right side of the brush roller 181 in contact with the brush roller 181. The cleaning blade 183 contacting a lower-right portion of the bias roller 182 at a free end portion 183*a* thereof is disposed under the bias roller 182.

Each of the brush roller 181 and the bias roller 182 is connected with the high-voltage output substrate (not shown) of the apparatus main assembly, and is supplied with a bias voltage of the same polarity (positive polarity in this embodiment). This bias voltage is set so that the bias voltage for the bias roller 182 is higher than the bias voltage for the brush roller 181. The opposing roller 184 as a first grounding member has electroconductivity, and is grounded and maintained at ground potential.

The negative polarity cleaning set 18N includes a brush roller 185 as a second attracting member, a bias roller 186 as a second collecting member and a cleaning blade 187 as a second scraping member. The brush roller 185 which is a brush member (fur brush roller) is constituted by, e.g., planting electroconductive brush fibers 185*b* in a cylindrical core portion 185*a* formed of a metal material (FIG. 5). This brush roller 185 contacts the lower surface of the secondary transfer belt 176 at a position downstream of the positive-side brush roller 181, and sandwiches the secondary transfer belt 176 between itself and the driving roller 171 of the secondary transfer unit 17. The bias roller 186 which is a roller member is disposed in a lower-left side of the brush roller 185 in contact with the brush roller 185. The cleaning blade 187 contacting a lower-right portion of the bias roller 186 at a free end portion 187*a* thereof is disposed under the bias roller 186.

Each of the brush roller 185 and the bias roller 186 is connected with the high-voltage output substrate (not shown) of the apparatus main assembly, and is supplied with a bias voltage of the opposite polarity (negative polarity in this embodiment) to the polarity of the above-described brush roller 181. This bias voltage is set so that the bias voltage for the bias roller 186 is higher than the bias voltage for the brush roller 185. The driving roller 171 of the secondary transfer unit 17 has electroconductivity, and is grounded and maintained at ground potential. That is, the driving roller 171 not only constitutes a part of the secondary transfer unit 17 but also is provided as a second grounding member corresponding to the negative polarity cleaning set 18N.

Figure 4:
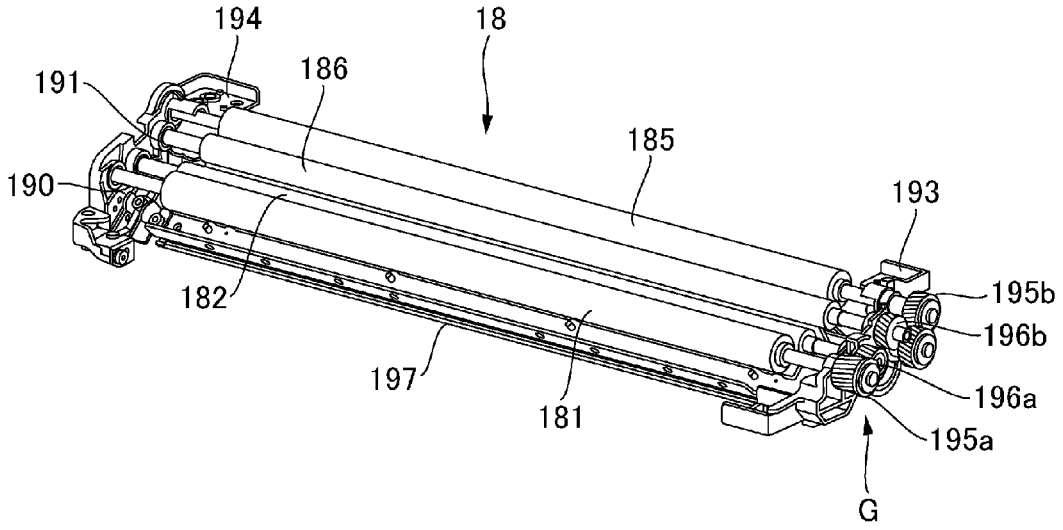
FIG. 4 is a perspective view showing the cleaner unit in First Embodiment.

The brush rollers 181 and 185 and the bias rollers 182 and 186 are, as shown in FIG. 4, disposed in parallel to each other and extend in the widthwise direction of the secondary transfer belt 176. The brush rollers 181 and 185 and the bias rollers 182 and 186 are rotatably supported at both end portions with respect to the axial direction by a front side plate 193 and a rear side plate 194 of the casing 192. At one end portion (front side) with respect to the axial direction, a driving force transmitting portion G consisting of gears 195*a* and 195*b* rotating integrally with the brush rollers 181 and 185 and gears 196*a* and 196*b* rotating integrally with the bias rollers 182 and 186 is provided. The brush rollers 181 and 185 and the bias rollers 182 and 186 are rotationally driven via the driving force transmitting portion G by an unshown driving motor.

The positive side brush roller 181 and the negative side brush roller 185 rotate counterdirectionally (counterclockwise) to the rotational direction of the secondary transfer belt 176 as shown in FIG. 5. The positive side bias roller 182 rotates codirectionally (clockwise) with the positive side brush roller 181 at an opposing portion therebetween. The negative side bias roller 186 rotates counterdirectionally to the rotational direction of the negative side brush roller 185. Accordingly, the two bias rollers 182 and 186 are rotationally driven from above toward below in opposite directions to each other in a side close to the other bias roller.

The positive side cleaning blade 183 contacts the bias roller 182 from below in a state in which the free end portion 183*a* thereof faces counterdirectionally to the rotational direction of the bias roller 182 (i.e., extends in an upper right direction). The negative side cleaning blade 187 positioned at the upper right of the cleaning blade 183 contacts the bias roller 186 from below in a state in which the free end portion 187*a* thereof faces counterdirectionally to the rotational direction of the bias roller 186 (i.e., extends in an upper left direction). Accordingly, the two cleaning blades 183 and 187 are disposed in an inverted V-shape as seen from the front side. These cleaning blades 183 and 187 are supported by the casing 192 via an unshown blade stay in a state in which the cleaning blades are positioned so that contact pressures of their free end portions with the bias rollers 182 and 186 are a predetermined pressure.

Figure 6:
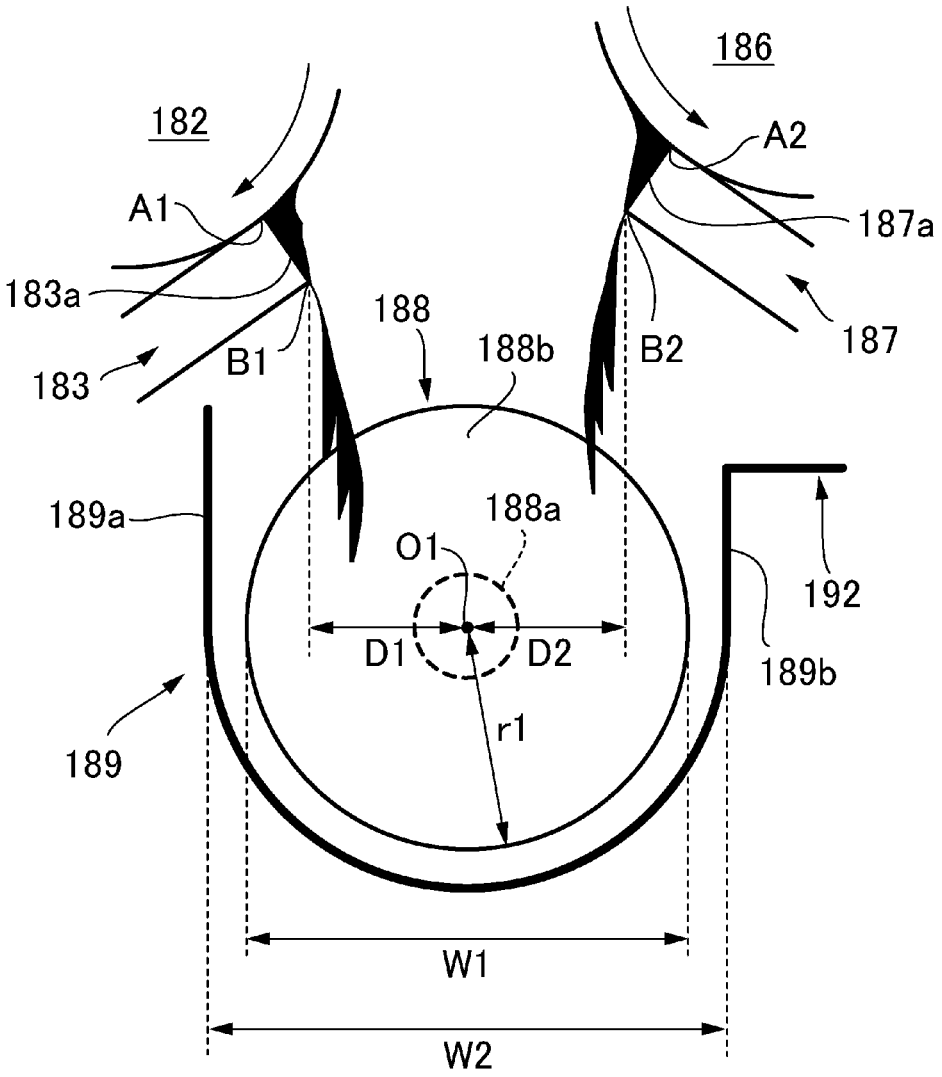
FIG. 6 is a schematic view showing a positional relationship between a cleaning blade and a feeding screw in First Embodiment.

The feeding screw 188 as a feeding member for feeding the deposited matter scraped off by the cleaning blades 183 and 187 is disposed at a position below the free end portions 183*a* and 187*a* of these blades, and is accommodated inside a feeding groove 189 constituting a part of the casing 192. The feeding groove 189 is, as shown in FIG. 6, partly surrounded by feeding walls 189*a* and 189*b* each standing substantially in the vertical direction at the bottom of the casing 192, and is formed in a U-shape in cross section and extends in parallel to the bias rollers 182 and 186. As seen from above, an axial center (line) of the feeding screw 188 is positioned between an axial center (line) of the bias roller 182 and an axial center (line) of the bias roller 186. Accordingly, a space between the bias rollers 182 and 186 which are disposed and spaced from each other in a direction (left-right direction) crossing their axial centers is configured to overlap with the feeding screw 188 as seen from above.

The feeding screw 188 includes a shaft (axis) portion 188*a* and a helical blade portion 188*b* formed at an outer peripheral surface of the shaft portion 188*a*, and is rotatably supported by the casing 192 at both end portions thereof with respect to the axial direction. The feeding screw 188 is connected with an unshown driving device in one side (front side) with respect to the axial direction, and is rotationally driven in a direction of feeding the deposited matter toward the other side (rear side) with respect to the axial direction. In the rear side of the feeding groove 189, an unshown opening through with the feeding walls are connected with the toner collecting container.

A positional relationship between the feeding screw 188 and the cleaning blades 183 and 187 will be described using FIG. 6. As described above, the feeding screw 188 is disposed inside the feeding walls 189*a* and 189*b* which oppose each other with an interval W2 larger than a diameter W1 of the blade portion 188*b* with respect to the left-right direction (W2>W1).

The free end portions 183*a* and 187*a* of the cleaning blades 183 and 187 are formed in a substantially rectangular shape, for example, and contact the bias rollers 182 and 186 at edges (end portions) A1 and A2 in one side of the free end portions 183*a* and 187*a*. Edges B1 and B2 which are the other ones of the edges (end portions) of the free end portions 183*a* and 187*a* and which are opposite from the edges A1 and A2 with respect to a blade thickness direction are positioned between the edges A1 and A2 with respect to the left-right direction. Accordingly, the edges B1 and B2 are the end portions in sides where the deposited matters scraped off at the edges A1 and A2 drop.

These edges B1 and B2 in the sides where the scraped deposited matters drop are disposed so as to overlap with the feeding screw 188 as seen from above. That is, both of a distance D1 between the edge B1 and an axial (shaft) center O1 of the feeding screw 188 with respect to the left-right direction and a distance D2 between the edge B2 and the axial center O1 with respect to the left-right direction are set so as to be smaller than a radius r1 of the blade portion 188*b* (D1<r1, D2<r1).

The shape of the free end portions of the cleaning blades 183 and 187 is not limited to the rectangular shape, but may also be another shape such as a single edged knife shape. In this case, the end portions of the free end portions in the sides where the deposited matters drop refer to positions where the deposited matters scraped off the bias rollers 182 and 186 are capable of dropping in the vertical direction.

[Cleaning of Secondary Transfer Belt]

The cleaner unit 18 constituted as described above cleans the secondary transfer belt 12 by the positive polarity cleaning set 18P and the negative polarity cleaning set 18N and feeds the deposited matters toward the toner cleaning container by the feeding screw 188. The positive side brush roller 181 and the negative side brush roller 185 remove the deposited matters such as the toners deposited on the surface of the secondary transfer belt 176 by electrostatic depositing forces by the bias voltages and a mechanical scraping force. The brush roller 181 to which the positive bias voltage is applied principally collects the negatively charged toner, and the brush roller 185 to which the negative bias voltage is applied principally collects the positively charged toner.

Figure 7:
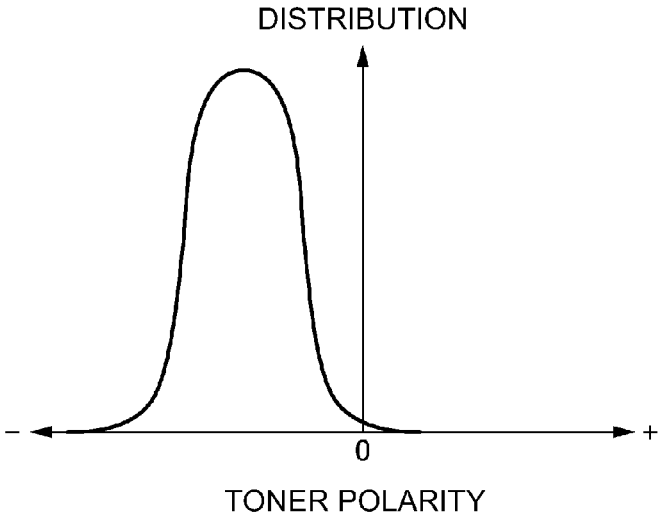
FIG. 7 is a schematic view showing a polarity distribution of a toner deposited on a secondary transfer belt.

In this embodiment, the toner images formed by the respective stations Pa, Pb, Pc and Pd and the toner particles of the control patches are negatively charged. For this reason, most of the toner particles deposited on the secondary transfer belt 176 at the secondary transfer portion T2 are charged to the negative polarity as shown in a graph of FIG. 7. Accordingly, most of the deposited matter deposited on the secondary transfer belt 176 are attracted to the positive side brush roller 181. The deposited matter, such as the toner particles into which positive electric charges are injected by the positive side brush roller 181, which is not attracted to the bias roller 181 is attracted to the negative side brush roller 182.

The deposited matters attracted to the brush rollers 181 and 185 are collected by the bias rollers 182 and 186 to which the bias voltages which are higher than the bias voltages applied to the brush rollers 181 and 185 are applied. The deposited matters collected by the bias rollers 182 and 186 are scraped off by the edges A1 and A2 of the cleaning blades 183 and 187 and are temporarily deposited on ridges (end surfaces) of the free end portions 183*a* and 187*a*. Then, the deposited matters overflowing from the edges B1 and B2 which are end portions of the ridges drop by gravitation and reach the feeding screw 188. Then, the deposited matters are fed toward the rear side with rotation of the feeding screw 188, and are collected in the toner collecting container.

The positive side brush roller 181 rotates in a rightward direction in a side (contact portion) where the roller 181 contacts the bias roller 182 (FIG. 5). Further, the bias roller 182 contacts a lower right portion of the brush roller 181, and therefore a tangential direction of the core portion 181*a* at the contact portion extends in an upper right direction and thus passes through above the free end portion 187*a* of the negative side cleaning blade 187. Accordingly, at least a part of the toner which scatters due to flicking or the like of the brush fibers a the contact portion reaches the free end portion 187*a* of the cleaning blade 187 as indicated by a broken line of an arrow in FIG. 5.

Comparison Example

Figure 8:
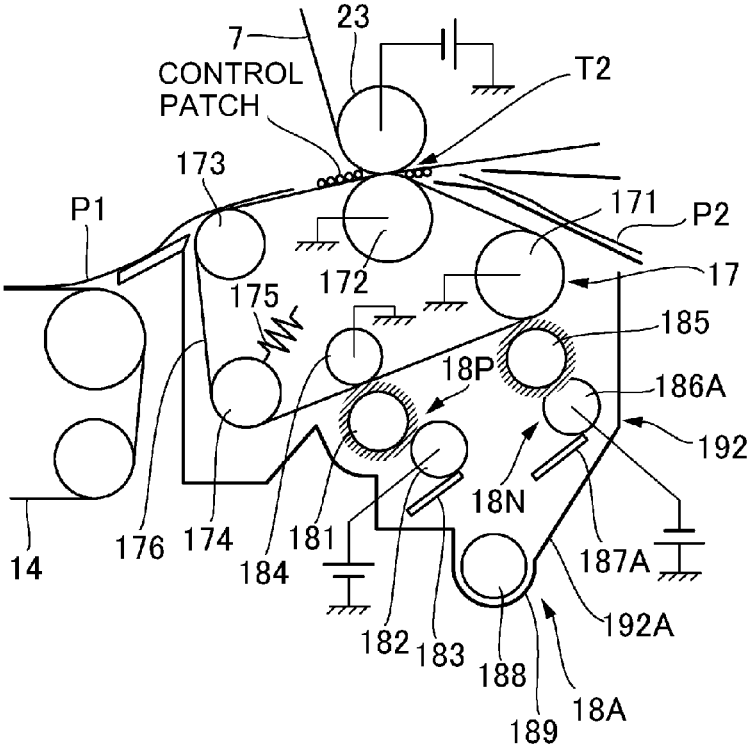
FIG. 8 is a sectional view showing a cleaner unit in Comparison Example.
Figure 9:
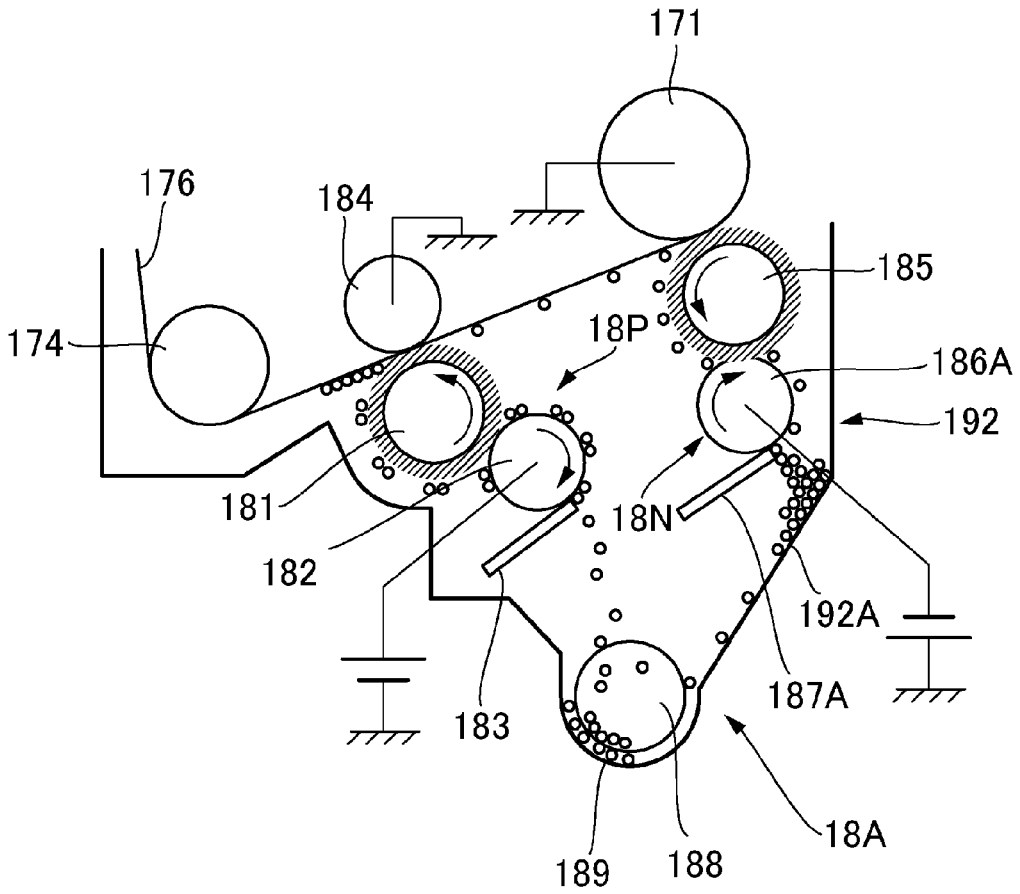
FIG. 9 is a sectional view for illustrating a phenomenon grooving in the cleaner unit in Comparison Example.

A cleaner unit 18A as Comparison Example with the cleaner unit 18A of First Embodiment will be described with reference to FIGS. 8 and 9. This cleaner unit 18A is different from the cleaner unit 18 of First Embodiment in that a deposited matter scraped off by a negative side cleaning blade 187A is guided to the feeding screw 188 by an inclined wall 192A provided as a part of a casing 192. Other constitutions are the same as those of the above-described cleaner unit 18, and therefore, members similar to those in First Embodiment are represented by the same reference numerals or symbols and will be omitted from description.

A negative side bias roller 186A of the cleaner unit 18A is rotationally driven codirectionally (clockwise) to the brush roller 185 at their opposing portion. The cleaning blade 187A contacts a lower right portion of the bias roller 186A in a state in which a free end portion thereof faces toward an upper right direction so as to extend counterdirectionally to the rotational direction of the bias roller 186A. For this reason, the free end portion of the cleaning blade 187A positions in a right side spaced from a right end portion of the feeding screw 188. The casing 192 includes the inclined wall 192A which extends from below the free end portion of the cleaning blade 187A toward a lower left direction and which is connected with the feeding groove 189. Accordingly, an upper surface of the inclined wall 192A is a movement path along which the deposited matter scraped off the bias roller 186A by the cleaning blade 187A slides down in the lower left direction by gravitation.

In the cleaner unit 18A, the deposited matter collected by the negative side brush roller 185 slides down along the inclined wall 192A after dropping on the inclined wall 192A. Then, the deposited matter which reached the feeding groove 189 is fed by the feeding screw 188 and is collected in the toner collecting container. However, by an adhesiveness of a substance (such as a wax) contained in the deposited matter, a part of the deposited matter is deposited on the wall surface of the inclined wall 192 (FIG. 9) in some cases.

In this way, when the deposited matter scraped by the cleaning blade 187A drops on the deposited matter deposited on the wall surface, an amount of the deposited matter deposited on the wall surface increases. Thus, when a space between the cleaning blade 187A and the casing 192 is clogged with the deposited matter, the deposited matter is not collected by the feeding screw 188 and remains inside the casing 192, and thus finally overflows from the inside of the casing 192. That is, in the case where the deposited matter scraped off by the cleaning blade 187A is guided by the wall surface of the inclined wall 192A or the like, there is a possibility that a state in which the inside of the cleaner unit 18A is clogged with the deposited matter is formed (toner clogging). When such a toner clogging generates, there is a liability that the toner clogging leads to improper cleaning such that the secondary transfer belt 176 is contaminated with the deposited matter which overflowed from the cleaner unit 18A.

Effect of this Embodiment

The cleaner unit 18 in this embodiment attracts not only the negatively charged deposited matter such as the toner particles to the positive side brush roller 181 but also the positively charged deposited matter to the negative side brush roller 185. As a result, not only the control patches transferred onto the secondary transfer belt 176 at the secondary transfer portion T2 but also the deposited matter deposited on the secondary transfer belt 176 can be collected efficiently. Further, the constitution in which the feeding screw 188 was provided below the free end portions 183*a* and 187*a* of the cleaning blades 183 and 187 and the deposited matters collected by the positive polarity cleaning set 18P and the negative polarity cleaning set 18N were fed by the single feeding member was employed. For this reason, compared with a constitution in which two feeding members are provided correspondingly to the two cleaning sets (18P and 18N), respectively, it is possible to reduce not only a size of the cleaning device but also part costs.

Incidentally, in the case where the feeding member for feeding the deposited matters scraped off the plurality of cleaning blades is provided, as in the cleaner unit 18A of Comparison Example, there is a liability that the improper cleaning generates by the deposition of the deposited matter on the wall surface of the casing 192 or the like. The cleaner unit 18 in this embodiment is disposed so that the edges B1 and B2, of the free end portions 183*a* and 187*a* of the cleaning blades 183 and 187, in sides where the scraped deposited matters drop overlap with the feeding screw 188 as seen from above. That is, the constitution in which the deposited matters dropped from the free end portions 183*a* and 187*a* of the cleaning blades 183 and 187 directly drop on the feeding screw 188 is employed. As a result, the deposition of the deposited matters scraped by the cleaning blades 183 and 187 on a portion other than the feeding groove 189 can be suppressed, so that it is possible to prevent generation of the improper cleaning. Thus, the cleaner unit 18 is capable of not only efficiently collecting the deposited matter in a limited space but also achieving a good cleaning performance for a long term.

Further, the constitution in which most of the deposited matter deposited on the secondary transfer belt 176 is collected by the positive side brush roller 181 and the toner in a slight amount which is scattered from the brush roller 181 reaches the negative side bias roller 186 was employed. As a result, even in the case where an amount of the toner attracted to the negative side brush roller 185 is extremely small, the toner is supplied in a very small amount to the negative side bias roller 186. Then, particles, of an external additive or the like contained in the toner, which are smaller in particle size than the toner particles enter a gap between the bias roller 186 and the cleaning blade 187 and thus lowers a friction coefficient between the bias roller 186 and the cleaning blade 187. As a result, an excessive frictional force is prevented from generating between the bias roller 186 and the cleaning blade 187, so that a problem such as turning-up or the like of the cleaning blade 187 can be prevented.

Modified Embodiment

In the above-described cleaner unit 18, in place of the negative polarity cleaning set 18N, a blade member 38 (FIG. 3) contacting the secondary transfer belt 176 may also be provided. This blade member 38 contacts the secondary transfer belt 176 in a state in which a free end portion thereof extends counterdirectionally to the feeding direction (arrow R direction) of the secondary transfer belt 176 in the upper left direction. In this case, an end portion of the free end portion of the blade member 38 in a side where the deposited matter drops may preferably be disposed so as to overlap with the feeding screw 188 as seen from above. As a result, the deposited matters scraped by the cleaning blade 183 and the blade member 38 can be dropped on the feeding screw 188 without being deposited on the wall surface or the like of the casing 192. That is, the cleaner unit in this modified embodiment is, similarly as in the above-described case where the negative polarity cleaning set 18N is provided, capable of not only efficiently collecting the deposited matter in the limited space but also achieving the good cleaning performance for the long term.

Second Embodiment

A cleaner unit 28 (cleaning device) in Second Embodiment will be described. The cleaner unit 28 is different from the cleaner unit 18 of First Embodiment in rotational directions of the bias rollers and arrangements of the cleaning blades. Other constitutions are the same as those of the above-described cleaner unit 18, and therefore members similar to those in First Embodiment are represented by the same reference numerals or symbols and will be omitted from description.

[Cleaner Unit]

Figure 10:
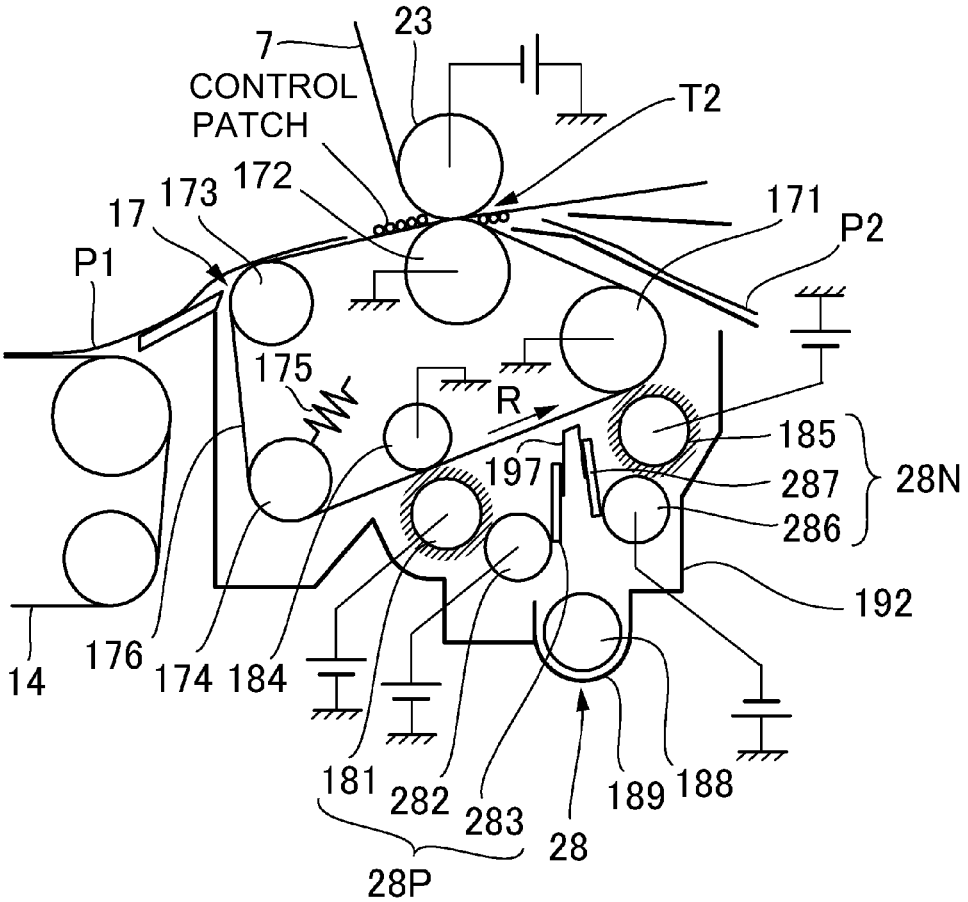
FIG. 10 is a sectional view showing a cleaner unit according to Second Embodiment of the present invention.

The cleaner unit 28 in this embodiment includes, as shown in FIG. 10, a positive polarity cleaning set 28P, a negative polarity cleaning set 28N and a feeding screw 188. The positive polarity cleaning set 28P includes a brush roller 181, a bias roller 282 rotating in a contact state with the brush roller 181, and a cleaning blade 283 contacting the bias roller 282 at a free end portion 283*a* thereof. The brush roller 181 and the bias roller 282 are connected with a high-voltage output substrate through contacts provided at end portions thereof with respect to the axial directions and are supplied with positive bias voltages, and the positive bias voltage applied to the bias roller 282 is set so as to be higher than the positive bias voltage applied to the brush roller 181. The negative polarity cleaning set 28N includes a brush roller 185, a bias roller 286 rotating in a contact state with the brush roller 185, and a cleaning blade 287 contacting the bias roller 286 at a free end portion 287*a* thereof. The brush roller 185 and the bias roller 286 are connected with a high-voltage output substrate through contacts provided at end portions thereof with respect to the axial directions and are supplied with negative bias voltages, and the negative bias voltage applied to the bias roller 282 is set so as to be higher (in absolute value) than the negative bias voltage applied to the brush roller 181. The feeding screw 188 is accommodated inside the feeding groove 189 formed as a part of the casing 192 and is disposed below the free end portions 283*a* and 287*a* of the cleaning blades 283 and 287. The feeding screw 188 is rotationally driven by an unshown driving source and feeds the deposited matters dropped on the feeding groove 189 to the rear side. At a rear side position of the feeding groove 189, an unshown opening is provided, and the feeding groove 189 is connected with the toner collecting container (bottle) through the opening.

Figure 11:
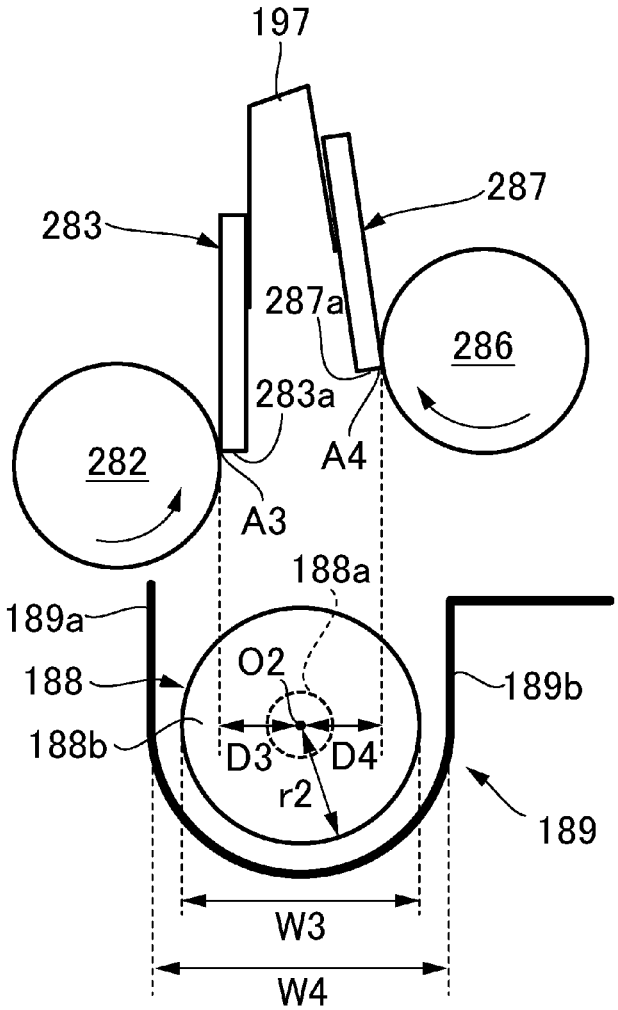
FIG. 11 is a sectional view showing a principal part of the cleaner unit in Second Embodiment.

The positive side bias roller 282 is, as shown in FIG. 11, rotationally driven in the counterclockwise direction. The positive side brush roller 181 is rotationally driven in a direction (counterclockwise direction) opposite to the feeding direction (arrow roller direction in FIG. 10) of the secondary transfer belt 176 at the contact portion, and therefore, the bias roller 282 and the brush roller 181 are rotated at the contact portion in opposite directions in which these rollers rub against each other. Further, the negative side bias roller 286 is rotationally driven in the clockwise direction which is codirectional at the contact portion with the rotational direction of the negative side brush roller 185 which is rotationally driven in the counterclockwise direction. Accordingly, the bias rollers 182 and 186 are rotationally driven from below toward above in opposite directions to each other in a side close to the other bias roller.

The positive side cleaning blade 283 and the negative side cleaning blade 287 are, as shown in FIG. 11, disposed between the positive side bias roller 282 and the negative side bias roller 286 with respect to the left-right direction. These cleaning blades 283 and 287 contact the bias rollers 282 and 296, respectively, in a state in which the free end portions 283*a* and 287*a* of thereof extend downwardly and counterdirectionally to the rotational directions of the bias rollers 282 and 286, respectively. Accordingly, of the free end portions 283*a* and 287*a*, edges A3 and A4 in sides where the free end portions 283*a* and 287*a* contact the bias rollers 282 and 296, respectively, are end portions in sides where the scraped deposited matters drop by gravitation. These cleaning blades 283 and 287 are supported on a left side surface and a right side surface of a blade supporting member 197 formed in a substantially inverted U-shape in cross section, and are fixed to the casing 192 via the blade supporting member 197.

Next, a positional relationship between the feeding screw 188 and the cleaning blades 283 and 287 will be described. The feeding screw 188 is disposed inside feeding walls 189*a* and 189*b* opposing each other with an interval W4 larger than a diameter W3 of the blade portion 188*b* with respect to the left-right direction (W4>S3). As seen from above, an axial center (line) O2 of the feeding screw 188 is positioned between an axial center (line) of the bias roller 282 and an axial center (line) of the bias roller 286. Accordingly, a space between the bias rollers 282 and 286 which are disposed and spaced from each other in a direction (left-right direction) crossing their axial centers is configured to overlap with the feeding screw 188 as seen from above.

The edge A3 of the positive side cleaning blade 283 is spaced leftwardly from the axial center O2 of the feeding screw 188 by a distance D3 in the left-right direction. Further, the edge A4 of the negative side cleaning blade 287 is in a position spaced rightwardly from the axial center O2 by a distance D4 in the left-right direction. These edges A3 and A4 are disposed so as to overlap with the feeding screw 188 as seen from above. In other words, the distances D3 and D4 from the edges A3 and A4 to the axial center O2 are set so as to be smaller than a radius r2 of the blade portion 188*b* (D3<r2, D4<r2).

In this embodiment, the two cleaning blades 283 and 287 are disposed in an inclined manner so that the cleaning blades 283 and 287 are somewhat increased, in a distance therebetween with respect to the left-right direction, downwardly, but positions and contact angles of the edges A3 and A4 may also be appropriately changed so long as the drop of the scraped deposited matters is not hindered. For example, the cleaning blades 283 and 287 may also be parallel to each other, or the distance between the cleaning blades 283 and 287 with respect to the left-right direction may also be somewhat increased upwardly.

Effect of this Embodiment

The cleaner unit 28 constituted as described above is capable of efficiently collecting the deposited matters scraped off the secondary transfer belt 176 by the brush roller 181 to which the positive bias voltage is applied and the brush roller 185 to which the negative bias voltage is applied. Further, the constitution in which the feeding screw 188 was provided below the free end portions 283*a* and 287*a* of the cleaning blades 283 and 287 and the deposited matters collected by the positive polarity cleaning set 28P and the negative polarity cleaning set 28N were fed by the single feeding screw 188 was employed. For this reason, it is possible to reduce not only a size of the cleaning device but also part costs.

In such a constitution, the cleaner unit 28 in this embodiment was disposed so that the edges A3 and A4, of the free end portions 283*a* and 287*a* of the cleaning blades 283 and 287, which are end portions in sides where the scraped deposited matters drop overlap with the feeding screw 188 as seen from above (in plan view). That is, the constitution in which the deposited matters scraped off the bias rollers 282 and 286 at the edges A3 and A4 directly drop on the feeding screw 188 was employed. As a result, the deposition of the deposited matters scraped by the cleaning blades 283 and 287 on a portion other than the feeding groove 189 can be suppressed, so that it is possible to prevent generation of the improper cleaning. That is, the cleaner unit 28 is capable of not only efficiently collecting the deposited matter in a limited space but also achieving a good cleaning performance for a long term.

Further, the cleaning blade 283 and 287 and the blade supporting member 197 are disposed using a space between the two bias rollers 282 and 296 which are disposed and spaced from each other in the left-right direction. For this reason, compared with First Embodiment, there is no need to ensure a space, at a position below the bias rollers 282 and 296, for placement of the cleaning blades and a supporting member for supporting the cleaning blades, so that the cleaning device can be made compact with respect to the up-down direction.

Other Embodiments

In the above-described First and Second Embodiments, the cleaning device for cleaning the secondary transfer belt 176 was described, but a cleaning device for cleaning another member of the image forming apparatus may also be used in the present invention. For example, a device (such as the intermediary transfer belt cleaning portion 10) for cleaning the intermediary transfer member, such as the intermediary transfer belt, as the member-to-be-cleaned may also be constituted similarly as in the case of the cleaner unit 18.

In the above-described First and Second Embodiments, the constitution in which the two bias rollers are rotated in the opposite directions to each other was described as an example, but a constitution in which their rotational directions are the same may also be employed. In this case, it is preferable that each of the cleaning blades is contacted to the associated bias roller in a state in which the free end portion thereof faces counterdirectionally to the rotational direction of the bias roller. Further, of the free end portions of the cleaning blades, end portions (edges) in sides where the scraped deposited matters drop are disposed at positions which overlap with the feeding screw (feeding member) as seen from above, so that it is possible to obtain effects similar to those of the above-described First and Second Embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133804 filed on Jul. 2, 2015, which is hereby incorporated by reference herein in its entirety.

What is claimed is:

1. An image forming apparatus for forming an image with a toner, comprising:

a movable member-to-be-cleaned on which the toner is deposited;

a first cleaning unit configured to remove the toner deposited on said member-to-be-cleaned, said first cleaning unit including a first attracting member, a first rotatable member and a first blade member, wherein said first attracting member contacts said member-to-be-cleaned while rotating and is supplied with a voltage of a first polarity to attract the toner deposited on said member-to-be-cleaned, wherein said first rotatable member contacts said first attracting member to move the toner from said first attracting member thereto, and wherein said first blade member contacts said first rotatable member at a first contact portion and scrapes deposited matter off said first rotatable member with rotation of said first rotatable member, and the toner scraped off by said first blade member drops by gravitation at a first position;

a second cleaning unit configured to remove the toner deposited on said member-to-be-cleaned, said second cleaning unit including a second attracting member, a second rotatable member and a second blade member, wherein said second attracting member contacts said member-to-be-cleaned while rotating and is supplied with a voltage of a second polarity to attract the toner deposited on said member-to-be-cleaned, wherein said second rotatable member contacts said second attracting member to move the toner from said second attracting member thereto, and wherein said second blade member contacts said second rotatable member at a second contact portion and scrapes deposited matter off said second rotatable member with rotation of said second rotatable member, and the toner scraped off by said second blade member drops by gravitation at a second position; and a feeding member configured to feed the toner dropped from the first position and the second position in a direction of a rotational axis thereof, wherein said feeding member rotates around the rotational axis and is provided vertically below the first position and the second position, wherein said feeding member is disposed such that vertical lines passing through the first position and the second position cross said feeding member, and wherein rotational directions of said first rotatable member and said second rotatable member are opposite to each other.

2. An image forming apparatus according to claim 1, wherein said feeding member is a screw including a helical blade portion provided around the rotational axis, and wherein as seen in a vertical direction, said first blade member and said second blade member are provided so that a distance from a center of the rotational axis to each of the first position and the second position is shorter than a radius of an outside rotation locus of said blade portion.

3. An image forming apparatus according to claim 2, wherein as seen in a vertical direction, the rotational axis of said screw is disposed between a rotational axis of said first rotatable member and a rotational axis of said second rotatable member.

4. An image forming apparatus according to claim 1, wherein said first blade member contacts said first rotatable member in a state in which a free end portion thereof faces said first rotatable member counterdirectionally to a rotational direction of said first rotatable member, wherein said second blade member contacts said second rotatable member in a state in which a free end portion thereof faces said second rotatable member counterdirectionally to a rotational direction of said second rotatable member, and wherein rotational directions of said attracting member, said second attracting member and said member-to-be-cleaned are the same direction.

5. An image forming apparatus according to claim 4, wherein as seen in a vertical direction, a rotational axis of said first rotatable member and a rotational axis of said second rotatable member are spaced from each other, wherein each of said first rotatable member and said second rotatable member rotates from above toward a side where said first rotatable member and said second rotatable member oppose each other, wherein an upper end of said first blade member contacts said first rotatable member, and wherein an upper end of said second blade member contacts said second rotatable member.

6. An image forming apparatus according to claim 4, wherein as seen in a vertical direction, a rotational axis of said first rotatable member and a rotational axis of said second rotatable member are spaced from each other, wherein each of said first rotatable member and said second rotatable member rotates from below toward above at a side where said first rotatable member and said second rotatable member oppose each other, wherein a lower end of said first blade member contacts said first rotatable member, and wherein a lower end of said second blade member contacts said second rotatable member.

7. An image forming apparatus according to claim 1, wherein said member-to-be-cleaned is an endless belt member, wherein said first attracting member is disposed so as to sandwich said belt member between itself and a first opposing member connected to a ground potential, and wherein said second attracting member is disposed so as to sandwich said belt member between itself and a second opposing member connected to a ground potential.

8. An image forming apparatus according to claim 1, further comprising an intermediary transfer member configured to once carry a toner image transferred therefrom onto a recording material, wherein said member-to-be-cleaned is a feeding belt configured to feed the recording material onto which the toner images are transferred from said intermediary transfer member at a transfer portion.

9. An image forming apparatus according to claim 1, wherein said member-to-be-cleaned is an intermediary transfer member configured to once carry a toner image transferred therefrom onto a recording material.

10. An image forming apparatus according to claim 1, wherein the first position is an edge portion provided at a side opposite from an edge portion where said first blade member contacts said first rotatable member, with respect to a thickness direction of said first blade member, and wherein the second position is an edge portion provided at a side opposite from an edge portion where said second blade member contacts said second rotatable member, with respect to a thickness direction of said second blade member.

11. An image forming apparatus according to claim 1, wherein said first attracting member and said second attracting member are fur brushes.

* * * * *